US008077007B2

(12) United States Patent
Urrea et al.

(10) Patent No.: US 8,077,007 B2
(45) Date of Patent: Dec. 13, 2011

(54) BLADE FUSE

(75) Inventors: Julio Urrea, Chicago, IL (US); James J. Beckert, Rolling Meadows, IL (US); Gary M. Bold, Palatine, IL (US); Seibang Oh, Elk Grove Village, IL (US); Juergen Scheele, Wildeshausen (DE)

(73) Assignee: Littlelfuse, Inc., Des Plaines, IL (US)

( * ) Notice: Subject to any disclaimer, the term of this patent is extended or adjusted under 35 U.S.C. 154(b) by 261 days.

(21) Appl. No.: 12/013,997

(22) Filed: Jan. 14, 2008

(65) Prior Publication Data

US 2009/0179728 A1 Jul. 16, 2009

(51) Int. Cl.
*H01H 85/08* (2006.01)
*H01H 85/02* (2006.01)

(52) U.S. Cl. ..... 337/161; 337/187; 337/198; 337/292

(58) Field of Classification Search ..... 337/161, 337/187, 292, 293, 198; D13/158–184
See application file for complete search history.

(56) References Cited

U.S. PATENT DOCUMENTS

| | | | | |
|---|---|---|---|---|
| 1,491,905 | A | | 4/1924 | Eustice |
| 2,308,435 | A | | 1/1943 | Wood |
| 2,863,967 | A | | 12/1958 | Swain |
| 3,189,712 | A | | 6/1965 | Kozacka |
| 3,261,950 | A | | 7/1966 | Kozacka |
| 3,301,978 | A | | 1/1967 | Kozacka |
| 3,529,271 | A | | 9/1970 | Swain |
| 3,629,036 | A | | 12/1971 | Isaacson |
| 3,786,402 | A | | 1/1974 | Horecky |
| 3,909,767 | A | | 9/1975 | Williamson et al. |
| 3,931,602 | A | * | 1/1976 | Plasko ..... 337/163 |
| 3,935,553 | A | | 1/1976 | Kozacka et al. |
| 3,962,782 | A | | 6/1976 | Williamson et al. |
| 4,023,264 | A | | 5/1977 | Schmidt, Jr. et al. |
| 4,023,265 | A | | 5/1977 | Aryamane |
| 4,040,175 | A | | 8/1977 | Williamson et al. |
| 4,056,884 | A | | 11/1977 | Williamson et al. |
| 4,059,334 | A | | 11/1977 | Bailey |
| 4,067,103 | A | | 1/1978 | Ciesmier |
| 4,069,076 | A | | 1/1978 | Fickes |
| 4,099,320 | A | | 7/1978 | Schmidt, Jr. et al. |

(Continued)

FOREIGN PATENT DOCUMENTS

CH 656979 7/1986

(Continued)

OTHER PUBLICATIONS

An International Search Report for International Patent Application No. PCT/US05/07484, Dec. 12, 2005.

*Primary Examiner* — Anatoly Vortman
(74) *Attorney, Agent, or Firm* — Kacvinsky Daisak, PLLC

(57) ABSTRACT

A blade fuse includes a first terminal includes an outer edge and an inner edge, the inner edge includes a first portion notched away from the inner edge beneath the first portion; a second terminal includes an outer edge and an inner edge, the inner edge include a second portion notched away from the inner edge beneath the second portion; an element extending from the first portion of the inner edge of the first terminal to the second portion of the inner edge of the second terminal; and a housing covering the element.

14 Claims, 8 Drawing Sheets

U.S. PATENT DOCUMENTS 4,099,321 A 7/1978 Aryamane
4,099,322 A 7/1978 Tait
4,099,828 A 7/1978 Stegmaier et al.
4,203,200 A 5/1980 Wiebe
4,221,455 A 9/1980 Cairns et al.
4,221,456 A 9/1980 Cairns et al.
4,224,592 A 9/1980 Urani et al.
4,245,208 A 1/1981 Belcher
4,300,281 A 11/1981 Panaro
4,343,530 A 8/1982 Leger
4,344,058 A 8/1982 Knapp, Jr. et al.
4,375,630 A 3/1983 Gaia
4,391,485 A 7/1983 Urani
4,414,526 A 11/1983 Panaro
4,417,225 A * 11/1983 Muller et al. ..... 337/198
4,434,548 A 3/1984 Beswick
4,499,447 A 2/1985 Greenberg
4,500,162 A 2/1985 Keglewitsch et al.
4,504,816 A 3/1985 Viola et al.
4,506,004 A 3/1985 Sullivan
4,544,907 A 10/1985 Takano
4,592,613 A 6/1986 Tong
4,604,602 A 8/1986 Borzoni
4,612,539 A 9/1986 Hosogoe et al.
4,670,729 A 6/1987 Oh
4,675,990 A 6/1987 Viola et al.
4,682,140 A 7/1987 Diaz-Noriega
4,698,294 A 10/1987 Lau et al.
4,712,081 A 12/1987 Bosley
4,722,701 A 2/1988 Bradt
4,724,606 A 2/1988 Sexton, Jr.
4,782,317 A 11/1988 Thwaites
4,827,238 A 5/1989 Kozel
4,831,353 A 5/1989 Gaia et al.
4,884,050 A 11/1989 Kozel
4,949,062 A 8/1990 Mollet
4,949,063 A 8/1990 Levko
4,951,026 A 8/1990 Ehlmann
4,958,426 A 9/1990 Endo et al.
4,972,170 A 11/1990 Ehlmann et al.
4,986,767 A 1/1991 Kozel
4,992,770 A 2/1991 Spalding et al.
4,994,779 A 2/1991 Douglass
4,998,086 A 3/1991 Kourinsky et al.
5,049,095 A 9/1991 Gugelmeyer
D321,683 S 11/1991 Marach
5,075,664 A 12/1991 Spalding et al.
5,077,534 A 12/1991 Douglass
5,085,600 A 2/1992 Damron
5,118,314 A 6/1992 Mangone et al.
5,139,443 A 8/1992 Armando
5,213,945 A 5/1993 Roos et al.
5,227,759 A 7/1993 Hatagishi
5,228,188 A 7/1993 Badihi et al.
5,229,739 A 7/1993 Oh et al.
5,235,306 A 8/1993 Kalra et al.
5,239,282 A 8/1993 Filomia
5,239,291 A 8/1993 Henricks et al.
5,249,985 A 10/1993 Obenauer
5,293,147 A 3/1994 Oh et al.
5,296,832 A 3/1994 Perreault et al.
5,324,214 A 6/1994 De Castro
5,343,185 A 8/1994 Mosesian et al.
5,346,411 A 9/1994 Nikkinen
5,357,234 A 10/1994 Pimpis et al.
5,373,278 A 12/1994 Saulgeot et al.
5,405,731 A 4/1995 Chandrasekaran et al.
5,426,411 A 6/1995 Pimpis et al.
5,444,428 A 8/1995 Carr et al.
5,476,395 A 12/1995 Raffles et al.
5,476,396 A 12/1995 De Castro
5,507,669 A 4/1996 Jannett et al.
D373,570 S 9/1996 Kudo et al.
5,552,757 A 9/1996 Blecha et al.
5,581,225 A 12/1996 Oh et al.
5,598,138 A 1/1997 Jaronczyk, Jr.
5,601,905 A 2/1997 Watanabe et al.
5,629,664 A 5/1997 Muramatsu et al.
5,662,496 A 9/1997 Kanamori
5,668,251 A 9/1997 Malik et al.
5,668,521 A 9/1997 Oh
5,726,621 A 3/1998 Whitney et al.
5,736,918 A 4/1998 Douglass
5,818,320 A 10/1998 Matsuoka
5,847,635 A 12/1998 Kudo
5,854,583 A 12/1998 Falchetti
5,883,562 A * 3/1999 Matsuoka et al. ..... 337/273
5,898,357 A 4/1999 Endo et al.
5,905,426 A 5/1999 Douglass
5,923,240 A 7/1999 Endo et al.
5,929,740 A 7/1999 Oh et al.
5,951,328 A 9/1999 Roper, Jr.
5,963,122 A 10/1999 Endo et al.
5,963,123 A 10/1999 Douglass
5,977,859 A 11/1999 Kawamura et al.
6,002,322 A 12/1999 Krueger et al.
6,007,350 A * 12/1999 Isshiki ..... 439/76.2
6,011,458 A 1/2000 Endo et al.
6,031,446 A 2/2000 Prohaska et al.
6,075,689 A 6/2000 Mitchell
6,157,287 A 12/2000 Douglass et al.
6,163,244 A 12/2000 Endo et al.
6,168,471 B1 1/2001 Santa Cruz et al.
6,194,989 B1 2/2001 Douglass
6,222,438 B1 4/2001 Horibe et al.
6,272,000 B1 8/2001 Spaunhorst et al.
6,294,978 B1 9/2001 Endo et al.
6,313,416 B1 11/2001 Abroy et al.
D451,889 S 12/2001 Ohashi et al.
6,326,878 B1 12/2001 Liang
D452,851 S 1/2002 Ohashi et al.
D454,842 S 3/2002 Ohashi et al.
6,359,543 B2 3/2002 Endo et al.
6,407,657 B1 6/2002 Oh
6,445,563 B1 9/2002 Endo
6,448,897 B1 * 9/2002 Ku ..... 340/638
6,452,474 B1 9/2002 Oh
6,457,995 B1 * 10/2002 Brooks ..... 439/620.29
6,461,171 B2 10/2002 Kanaoka et al.
6,507,264 B1 * 1/2003 Whitney ..... 337/159
6,520,804 B2 * 2/2003 Sumida et al. ..... 439/620.27
6,529,113 B2 3/2003 Endo et al.
6,531,949 B2 3/2003 Endo et al.
6,542,064 B2 4/2003 Endo et al.
6,545,585 B2 4/2003 Endo et al.
6,556,120 B2 4/2003 Endo et al.
6,556,121 B2 * 4/2003 Endo et al. ..... 337/260
6,558,198 B2 * 5/2003 Kobayashi et al. ..... 439/620.29
6,566,599 B2 * 5/2003 Sumida et al. ..... 174/50
6,616,484 B1 9/2003 Fan Wong
6,622,375 B1 9/2003 Endo et al.
6,642,834 B1 11/2003 Oh et al.
6,666,722 B2 12/2003 Fukumori et al.
6,666,723 B2 12/2003 Fukumori et al.
6,726,506 B2 4/2004 Fukumori et al.
6,734,780 B2 5/2004 Endo et al.
6,753,753 B2 6/2004 Endo et al.
6,771,477 B2 8/2004 Milanczak
6,848,946 B2 2/2005 Vicenza et al.
D575,746 S * 8/2008 Bold ..... D13/161
D580,887 S * 11/2008 Beckert ..... D13/173
7,479,866 B2 * 1/2009 Goldsberry et al. ..... 337/198
2001/0026209 A1 10/2001 Kondo et al.
2003/0076213 A1 * 4/2003 Endo et al. ..... 337/198
2004/0070485 A1 * 4/2004 Andoh et al. ..... 337/198
2007/0080772 A1 * 4/2007 Schulte et al. ..... 337/198

FOREIGN PATENT DOCUMENTS

DE 2500364 7/1975
DE 3040884 5/1982
DE 103 58 444 A1 7/2006
GB 2090081 6/1982
GB 2375443 A * 11/2002
JP 54-133203 10/1979
JP 56-2560 1/1981
JP 56-2561 1/1981
JP 56-51239 5/1981

| | | | | |
|---|---|---|---|---|
| JP | 56-90354 | | | 7/1981 |
| JP | 57-204647 | | | 12/1982 |
| JP | 58-154549 | | | 9/1983 |
| JP | 07105826 | A | * | 4/1995 |
| JP | 10199395 | A | * | 7/1998 |
| JP | 2000030599 | A | * | 1/2000 |
| JP | 2000030600 | A | * | 1/2000 |
| JP | 2000-260290 | | | 9/2000 |
| JP | 2000-260294 | | | 9/2000 |
| JP | 2002084632 | A | * | 3/2002 |
| JP | 1139245 | | | 4/2002 |

* cited by examiner

BLADE FUSE

BACKGROUND

The present disclosure relates to fuses and more particularly to blade fuses.

Blade fuses, such as automotive blade type fuses are known in the art. Blade fuses protect electrical automotive circuits from short circuits and current overloads. The protection results from a melting of an element of the fuse and therefore an opening of the circuit protected by the fuse. Upon a short circuit or current overload of a certain magnitude and over a predetermined length of time, the fuse element or link breaks or opens.

Blade fuses are used extensively in automobiles. Automobile manufacturers are constantly looking for ways to reduce cost, weight and space as much as possible. Blade fuse manufacturers also strive to reduce costs, such as material and manufacturing costs, as much as possible.

Automobile manufacturers on the other hand are increasing the amount of electronic control and electrical devices and accessories used in automobiles. The increasing amount of electrical content is forcing increased electrical function within the same space.

A need therefore exists for a robust blade type fuse that saves space.

SUMMARY

The present disclosure relates to blade fuses and in particular blade fuses for use in automobile applications. Automobile manufacturers seek fuses having higher and higher ratings in smaller and smaller packages. The fuses discussed herein attempt to address those needs.

In one embodiment, a blade fuse includes a pair terminals and a fuse element. The terminals at their inner edges are narrowed at certain portions to allow a particular fuse element to maintain its desired width, while allowing the overall width of the combined terminals and element to be narrower than they would otherwise would be. This allows an overall narrower fuse to be provided, which saves space. In one embodiment, a gap is provided between the inner edges of the terminals that is at least fifty percent of the overall width of the terminals at the lower edge of fuse mounting portions of the terminals. The gap can be achieved for example by notching out at least thirty-five percent of the inner edges of the terminals. The remaining portions of the terminals at the notches are wide enough to accept or define stake holes that allow the housing to be staked to the terminal portion of the fuse.

The notched portions of the terminals can extend through the top edges of the terminals or can be notched only at the portions needed to attach to the fuse element. The notched portions can be aligned with one another or be offset as required by the terminal. The notched edges can alternatively be symmetrical or not symmetrical about a centerline through the fuse. Further, the outer edges of the terminals can be straight or have one or more jog as desired.

The elements as discussed herein can have various shapes that fit within the widened gap created by the notches. The shapes can be U-shaped, S-shaped, V-shaped, serpentine or otherwise be curved. The elements can also be straight, e.g., diagonally disposed relative to the terminals.

The mounting portions or lower portions of the terminals can be straight. The widths of the lower terminal portions with respect to a gap between the lower portions in one embodiment are structured such that the widths are larger than the gap. This is achieved or aided by the addition of protrusions that extend inwardly from the inside edge of the terminals. Such structure prevents the terminals from extending upwardly into a housing of a second fuse, e.g., during shipping, which could damage the second fuse protected by the housing. Such configuration enables the fuse housing to not have a bottom tab that folds up between the terminals, protecting the inside of the housing.

In another primary embodiment, the fuse includes three terminals, wherein the center terminal is a common or buss terminal. The outer terminals are each connected to the inner buss terminal via a separate fuse element. Thus the overall fuse provides two fuses. The inner edges of the three terminals are again notched to allow the element to be as wide sized as desired, while providing an overall narrower fuse than would otherwise be provided if such notches are not provided. The lower or mounting portions of the terminals of the three terminal fuse also have a width that is greater than gaps formed between the terminals, such that again the terminals of one fuse can not extend between the terminals of another fuse and into the housing of the other fuse covering the two fuse elements. Such structure again allows the housing to not have in this case two lower tabs that would bend up between the three terminals to protect the underside or the housing.

The fuse elements of the three terminal fuse can have like or different shapes and ratings. The elements can have any of the shapes discussed herein for the two terminal fuse. Further, the elements can be structured such that the notches defined at the upper portions of the inner edges of the terminals can be aligned, misaligned, continuous, discontinuous, extended through an upper edge or surface of the terminal or not.

It is accordingly an advantage of the present disclosure to provide an improved blade fuse.

It is another advantage of the present disclosure to provide a narrowed blade fuse.

It is a further advantage of the present disclosure to provide a multi-element, triple terminal fuse, which provides an overall narrower profile than two like separate fuses.

Moreover, it is an advantage of the present disclosure to structure the lower portions of the fuse terminals such that the lower portions cannot be inserted between like lower portions of another fuse during shipping, in which case the fuses can become wedged together undesirably.

Still further, it is an advantage of the present disclosure to provide a blade fuse having a housing, which does not require a lower flap bent up between the terminals of the fuse.

Additional features and advantages are described herein, and will be apparent from, the following Detailed Description and the figures.

DETAILED DESCRIPTION

Figure 1:
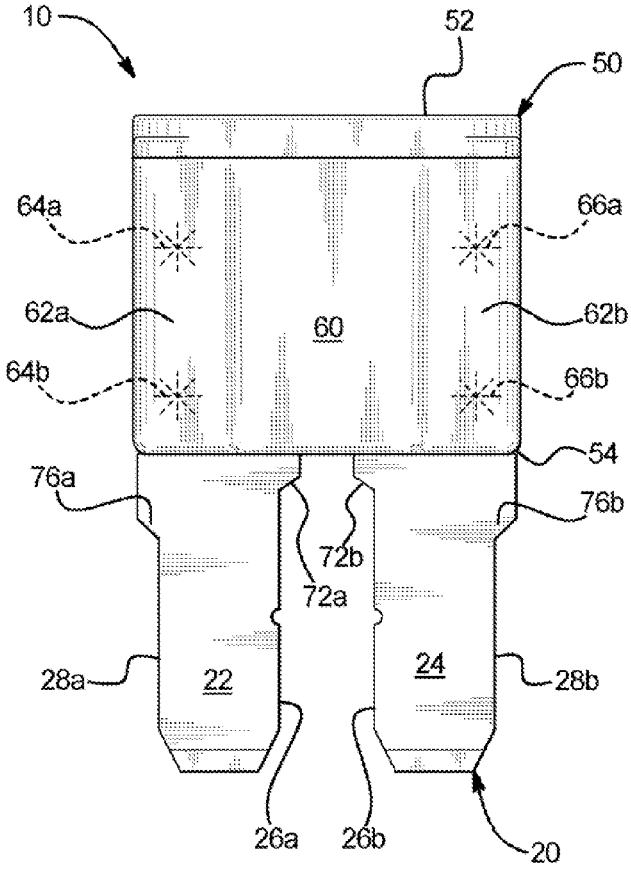
FIGS. 1 to 3 are front, side and top views, respectively, of one embodiment of an assembled blade fuse of the present disclosure.

Referring now to the drawings and in particular to FIGS. 1 to 11, one embodiment of a fuse 10 of the present disclosure is illustrated. Fuse 10 includes a conductive or metal portion 20 and an insulating housing 50. Conductive or metal portion 20 can be made of any suitable conductive material, such as metal. In various embodiments, conductive portion 20 is made of copper, aluminum, zinc, nickel, tin, gold, silver and any alloys or combinations thereof. In alternative embodiments, the conductive portion 20 or sections thereof can be plated with one or more metal or conductive plating. In various embodiments, conductive portion 20 is stamped (cut and trimmed) and coined (made thinner), wire electrical discharge machining ("EDM") cut and milled, laser cut and milled or electro-etched.

Insulating housing 50 is made of any suitable plastic or non-conductive material. For example, housing 50 can be made of any of the following materials: polycarbonate, polyester, polyethylene, polypropylene, polystyrene, polyvinylchloride, polyvinylidene chloride, acrylic, nylon, phenolic, polysulfone and any combination or derivative thereof. Housing 50 in one embodiment is injection molded or extrusion molded.

Figure 4:
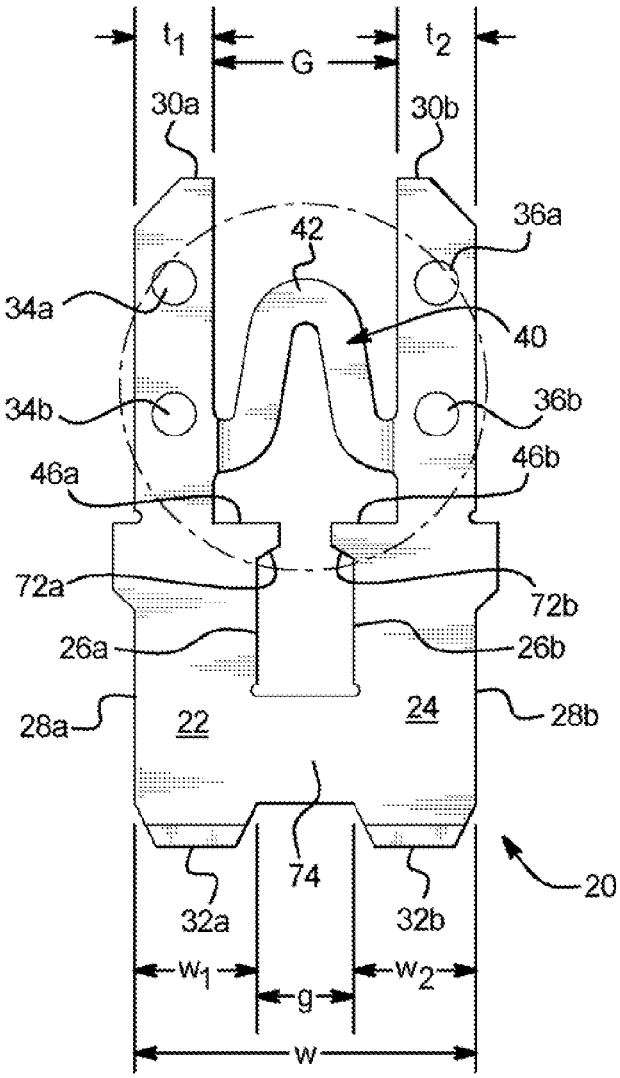
FIGS. 4 to 6 are front, side and top views, respectively, of one embodiment of a metal portion of the fuse of FIG. 1.
Figure 5:
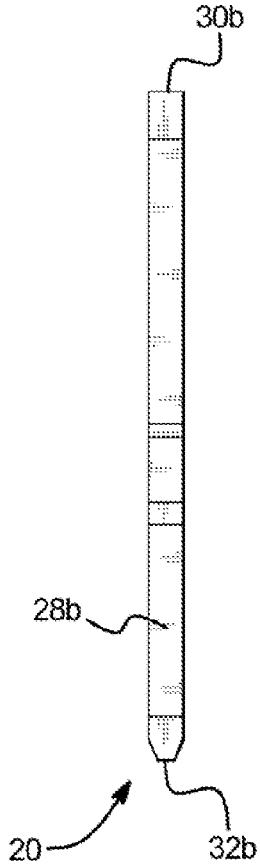

As seen in FIGS. 1 and 4, metal portion 20 includes a pair of terminals 22 and 24. Terminals 22 and 24 are sized and shaped appropriately to be mated to a pair of female terminals (not illustrated) that extend from a fuse block, for example, a fuse block of an automobile. Terminal 22 includes an inner edge 26*a*, an outer edge 28*a*, an upper edge 30*a* and a lower edge 32*a*. Likewise, terminal 24 includes an inner edge 26*b*, an outer edge 28*b*, an upper edge 30*b* and a lower edge 32*b*. Upper edges 30*a* and 30*b* serve as probe points for a user to detect the integrity of a fuse element 40 linking terminals 22 and 24 electrically.

Figure 7:
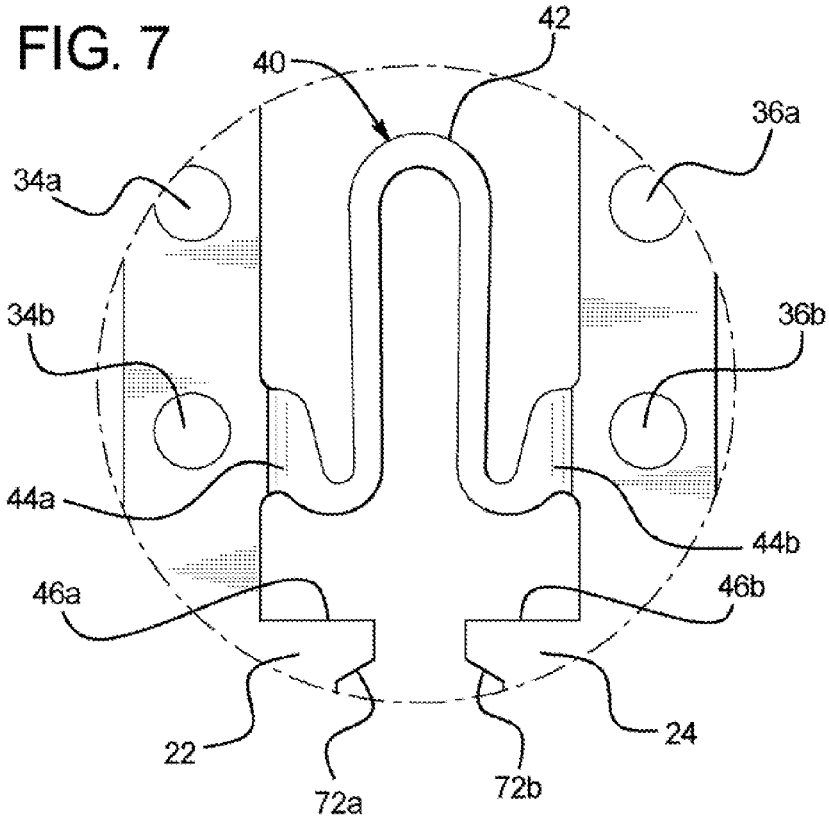
FIGS. 7 to 11 illustrate alternative embodiments for a fuse element of the metal portion the fuse of FIG. 1.
Figure 8:
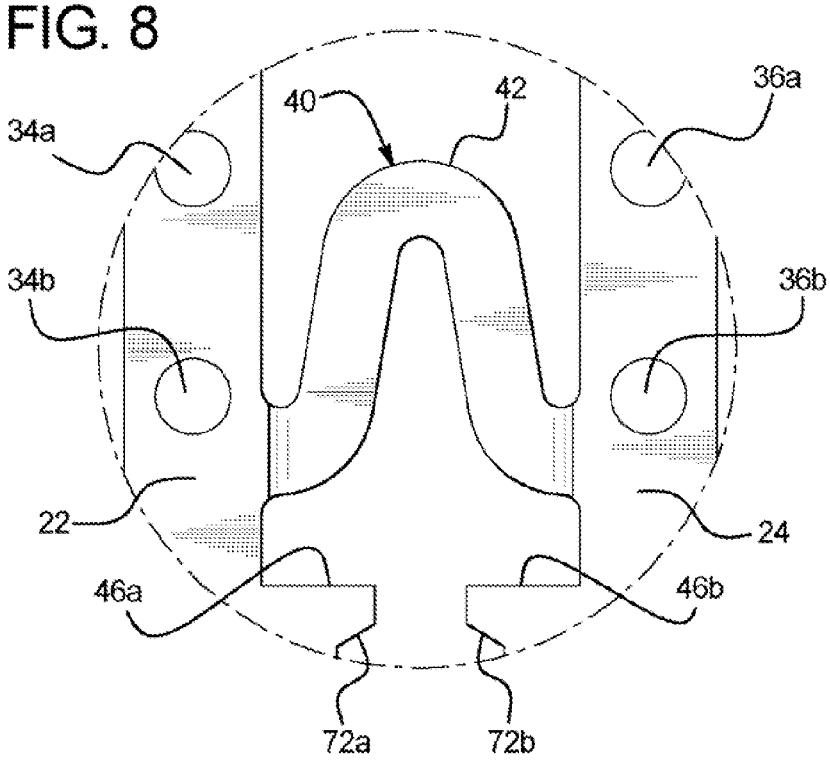
Figure 9:
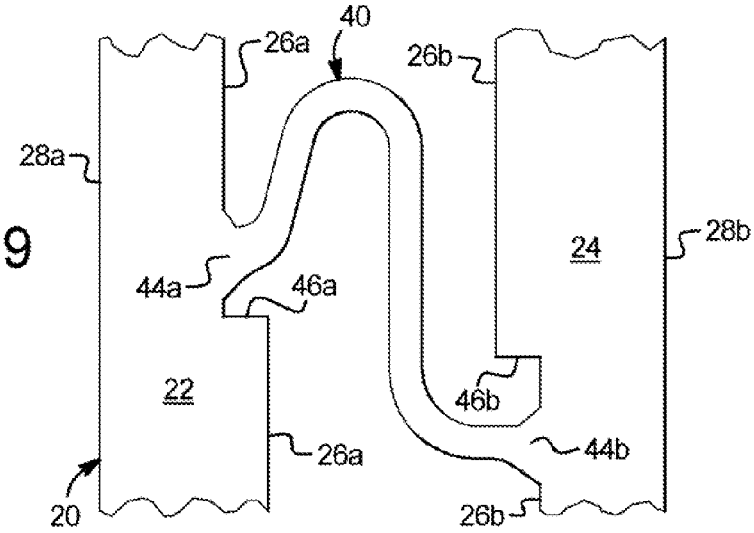
Figure 10:
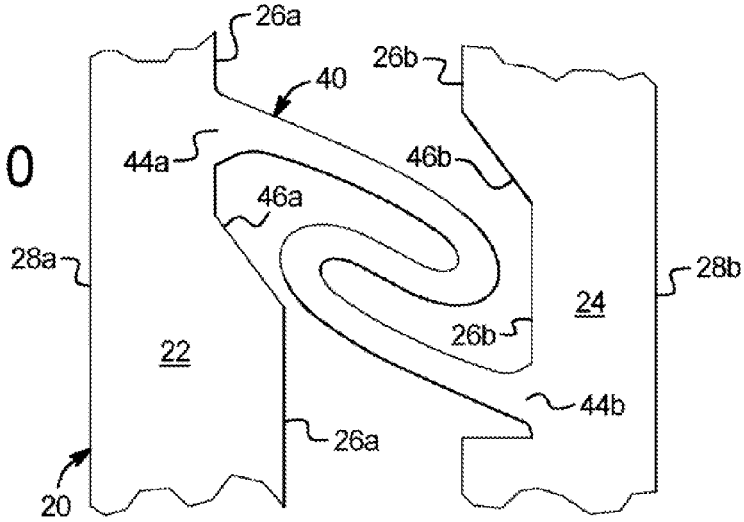
Figure 11:
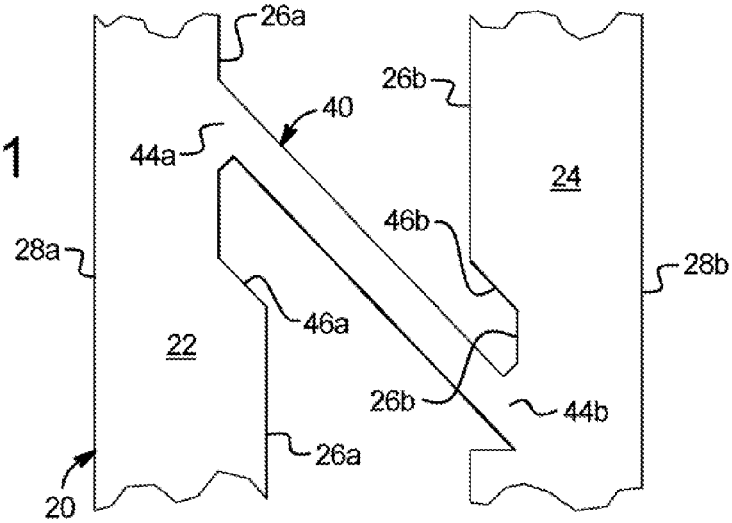

As mentioned above, conductive portion 20 includes a fuse element or fuse link 40 that connects terminals 22 and 24 electrically. Fuse element or link 40 is illustrated in FIGS. 4, 7 and 8 as having an inverted "U" or "V" shaped portion 42, in which the ends of the "U" are connected respectively to terminals 22 and 24 via conductive interfaces 44*a* and 44*b*. FIGS. 9 to 11 illustrate that portion 42 of fuse link 40 can have alternative shapes as desired, such as a serpentine shape, "S" shape, "N" shape, straight shape, etc.

Figure 6:
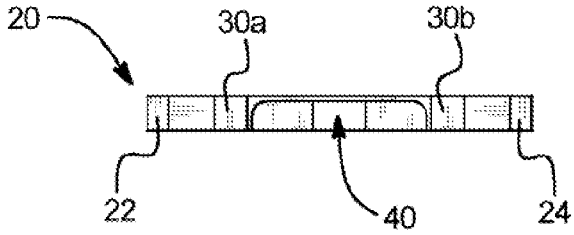

As seen best in FIG. 6, element 40 can be thinned and/or contoured as needed to produce a fuse 10 having desired electrical opening characteristics. Element 40 is coined, milled or otherwise machined on one surface or side, so that element 40 resides closer to one surface of terminals 22 and 24 as seen best in FIG. 6. Element or link 40 and terminals 22 and 24 in an alternative embodiment share a common midplane.

Fuse element 40 can be made of the same type or different type of material as terminals 22 and 24. Fuse element 40 and thus fuse 10 are accordingly rated for a desirable amperage. For automotive uses, for example, element 40 and fuse 10 can be rated for from one amp to about eighty amps for short circuits and low-overload events (e.g., events at 135% of fuse rating). For uses other than automotive uses, fuse 10 and element 40 can have different amperage ratings as desired.

Terminal 22 defines an upper aperture 34*a* and a lower aperture 36*a*. Terminal 24 defines an upper aperture 34*b* and a lower aperture 36*b*. Apertures 34*a*, 34*b*, 36*a* and 36*b* are stake holes, which allow housing 50 to be staked to conductive portion 20 as discussed herein.

Figure 2:
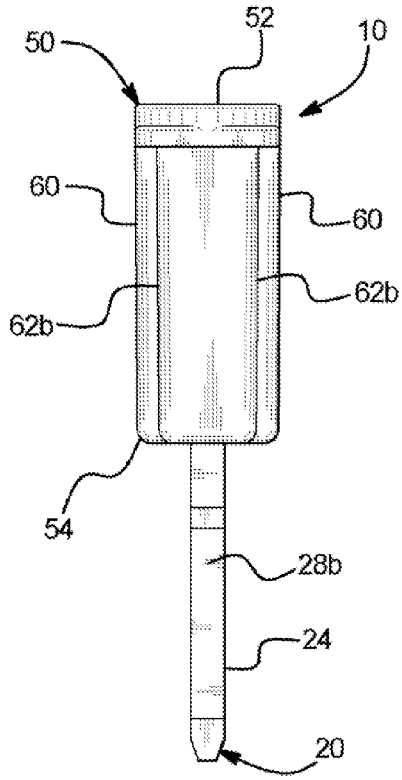
Figure 3:
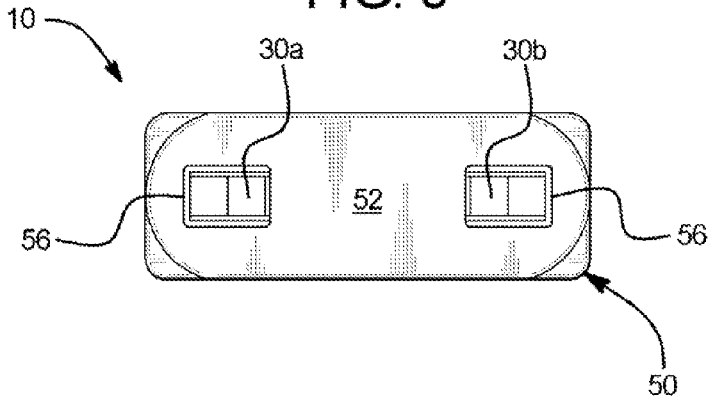

As seen in FIGS. 1 to 3, insulating housing 50 includes a top 52 and a body 54. Top 52 defines probe apertures 56. Body 54 of housing 50 covers element 40 and at least a portion of the front and back surfaces of terminals 22 and 24. As seen in FIG. 2, housing 50 in the illustrated embodiment covers the outer edges 28*a* and 28*b* of terminals 22 and 24. Alternatively, because the faces of fuse housing 50 are securely attached to conductive portion 20 via cold or hot staking, housing 50 does not have to cover outer edges 28*a* and 28*b* of terminals 22 and 24.

Body 54 (on both sides) includes or defines outwardly extending projections 60. Each projection 60 extends outwardly on its side of housing 50 from insulating flange sections 62*a* and 62*b*. Flange section 62*a* covers outer parts of the front and rear faces of terminal 22. Likewise, flange section 62*b* covers outer parts of the front and rear faces of terminal 24. Flange sections 62*a* and 62*b* include staking areas 64*a*, 66*a*, 64*b* and 66*b*, respectively. Those staking areas are provided on both sides of housing 50 in one embodiment. Areas 64*a*, 66*a*, 64*b* and 66*b* are cold staked. The areas are alternatively heated to a temperature sufficient to melt or deform the insulation or plastic material of housing 50 for hot staking. Insulating material (cold staked or heated) extends into apertures 34*a*, 36*a*, 34*b* and 36*b* of terminals 22 and 24, respectively. The cold or hot staked material provides mechanical attachment between terminal portion 20 and housing 50.

Staking holds housing 50 and conductive portion 20 together and tends to prevent outward pivoting of the surfaces of body 54 relative to top 52 of housing 50. Staking as shown is performed in multiple places for each terminal 22 and 24. Staking also tends to prevent element 40, which is thinner and weaker than the terminals, from bending inadvertently. Staking further tends to prevent terminals 22 and 24 from translating with respect to each other and from pivoting inwardly or outwardly about multiple axes extending perpendicularly from the broad face (FIG. 4) and narrow face (FIG. 6) of terminal portion 20.

As illustrated, housing 50 in one embodiment does not include a flap at its bottom that extends across an opening at the bottom of body 54, between the faces of body 54. One important purpose of such tab found on other blade fuses is to prevent a terminal of one fuse from lodging within the housing of another fuse during shipping or otherwise when the fuses are placed together loosely. As seen in FIG. 4, the width w1 and w2 of terminals 22 and 24, respectively (which can be the same for both terminals), is wider than a gap distance "g" between terminals 22 and 24. This prevents terminals 22 and 24 of one fuse 10 from being forced between the terminals of another fuse at any angle. That is, the equivalent width of the other fuse at any angle relative to fuse 10 is wider than the gap distances "g".

FIGS. 2, 4, 7 and 8 also illustrate that terminal portion 20 of fuse 10 includes projections 72*a* and 72*b*, which project inwardly from inner edges 26*a* and 26*b* of terminals 22 and 24, respectively. Projections 72*a* and 72*b* prevent terminals 22 and 24 of one fuse 10 from being forced into housing 50 of another fuse 10 without having to provide housing 50 with the above-described flap that bends upwardly to close off the bottom of the housing.

FIG. 4 shows metal portion 20 of fuse 10 in an intermediate state of manufacturing. Here, a tab 74 connects terminal 22 to terminal 24 to hold terminals 22 and 24 together while various parts of metal portion 20 are stamped and coined (or otherwise formed). Tab 74 protects terminals 22 and 24 from becoming bent or deformed during such process steps. Tab 74 is eventually stamped away (or otherwise removed) to separate terminals 22 and 24 as seen in FIG. 1. Outer edges 28*a* and 28*b* of terminals 22 and 24 as seen in FIGS. 1 and 4 each include a jog 76*a* and 76*b*, respectively, which helps to position housing 50 onto metal portion 20.

Fuse 10 of FIGS. 1 to 11 is advantageous in one respect because it has a terminal portion 20 having a nominal overall width W as seen in FIG. 4, which is thinner than that of previously used fuses. In one embodiment, the nominal overall width W as seen in FIG. 2 is 7.8 mm: the widths w1 and w2 of terminals 22 and 24 respectively are the same and are about 2.8 mm. A small gap width g between terminals 22 and 24 is accordingly 2.2 mm. Applicants note that other dimensions can be used, however, the above dimensions yield a center to center distance between terminals 22 and 24 of approximately 5 mm, which Applicants feel will be desirable in the automotive market especially.

One constraint in attempting to provide a narrower fuse 10 is that the width of element 40, shown in FIG. 4 as larger gap width G, needs to leave enough space for the curved portion 42 of element 40 to have a necessary length and make its necessary bend(s) given the width of the curved portion 42 and the constraints of the forming technique. The bend(s) of curved portion 42 is made so that the overall length of element 40 is sufficient for whatever rating the element is supposed to have. Accordingly, fuse 10 includes notches 46*a* and 46*b* in terminals 22 and 24, respectively, which narrow the upper portions of the terminals.

As illustrated, in one example the terminals are narrowed from 2.8 mm at the bottom to about 1.8 mm at the top. It is expected that the terminals can be narrowed about 35 percent or greater to provide the desired gap width G for terminal 40, while holding the overall width to a desired narrowed width. Narrowing the terminals 22 and 24 in the illustrated case to about 35.7 percent from 2.8 mm to 1.8 mm and holding the overall nominal width to 7.8 mm yields a big gap width G of about 4.2 mm, which is sufficient to provide the different elements 40 shown in FIGS. 4, 7 and 8. Thus the gap width G for element 40 can be at least 50 percent of the overall (nominal) width W of fuse 10. In the illustrated example, terminal gap width G is about 54 percent of the overall nominal width W. Gap width G could be a larger percentage of overall width W if desired.

One constraint limiting how big gap width G can be is that the upper widths t1 and t2 of terminals 22 and 24 respectively need to be large enough to support staking apertures 34*a*, 34*b*, 36*a* and 36*b*, respectively. Those apertures are laser cut, wire EDM'd, punched, stamped, or otherwise formed mechanically and require a sufficient amount of material around the outer diameter of the holes, so that the upper portions of elements 22 and 24 do not bend, rip or become otherwise deformed in forming staking apertures 34*a*, 34*b*, 36*a* and 36*b* and in the staking process itself.

FIGS. 7 and 8 show different examples of elements 40 that can be provided within gap width G shown in connection with FIG. 4. Each of elements 40 in FIGS. 7 and 8 includes attachment portions 44*a* and 44*b*, which are in at least approximate alignment with one another. Accordingly, notches 46*a* and 46*b* are also in approximate alignment with another. In the embodiment illustrated in FIGS. 1 to 8, notches 46*a* and 46*b* are straight from the bottom of the notches through the tops 30*a* and 30*b*, respectively, of terminals 22 and 24. It should be appreciated however that the notches do not have to be straight as shown in more detail below.

In FIG. 7, element 40 includes a tightly bent U-shaped section 42, in which the legs of the U are substantially vertical, substantially parallel, although the bend at the top of U-shaped section 42 may actually be slightly greater than 100 degrees. The connection sections 44*a* and 44*b* are rounded and made more robust than the thin bent portion 42. The width of element 40 can be about 0.5 mm. Element 40 in FIG. 7 has a rating of about five amps.

FIG. 8 illustrates a more V-shaped element 40, which is wider than the element of FIG. 7. For example, the element can be 1 mm wide. Element 40 of FIG. 8 has a rating of about thirty amps. The gap width G of about 4.2 mm accordingly provides enough room for a full line of fuse element ratings.

FIG. 10 illustrates alternative notches 46*a* and 46*b*, which can include slanted rather than right-angle notching. Further, connection section 44*a* of terminal 22 is located above connection section 44*b* of terminal 24, illustrating that the connection sections and associated notches do not have to be aligned or symmetrical to each other. Terminal 24 of FIG. 10 illustrates that notch 46*b* does not extend all the way through the top 30*b* of the terminal.

FIG. 11 illustrates that terminal 40 in one embodiment is straight. Here to achieve the needed length, element 40 is disposed diagonally from an upper connection section 44*a* to a lower connection section 44*b*. Notch 46 does not extend all the way through the top 30*b* of terminal 24. In both FIGS. 10 and 11, notch 46*a* begins at a higher elevation point than notch 46*b*.

FIG. 9 illustrates an inverted U terminal 40, similar to that of FIGS. 4, 7 and 8. Here however, as with FIGS. 10 and 11, notch 46*a* is located elevationally above notch 46*b*. Connection section 44*a* is located above and is not aligned with connection section 44*b*. Further, notch 46*b* does not extend through the top of 30*b* of terminal 24.

Referring now to FIGS. 12 to 18, fuse 110 illustrates another embodiment of a narrowed fuse of the present disclosure. Fuse 110 includes many of the same components as fuse 10 discussed above. Fuse 110 includes a metal portion 120 and a housing 150. Any of the materials discussed above for metal portion 20 and housing 50 are equally applicable to metal portion 120 and housing 150 of fuse 110, including any of the materials for dual elements 140*a* and 140*b*.

As seen, fuse 110 includes two outer terminals 122 and 124 and an middle terminal 148. Outer terminal 122 includes an outer edge 128*a*, an inner edge 126*a*, an upper edge 130*a* and a bottom edge 132*a*. Outer terminal 124 likewise includes an inner edge 126*b*, an outer edge 128*b*, an upper edge 130*b* and a bottom edge 132*b*. Middle terminal 148 includes two inner edges 126*c* and 126*d*, a top edge 130*c* and a bottom edge 132*c*.

Figure 12:
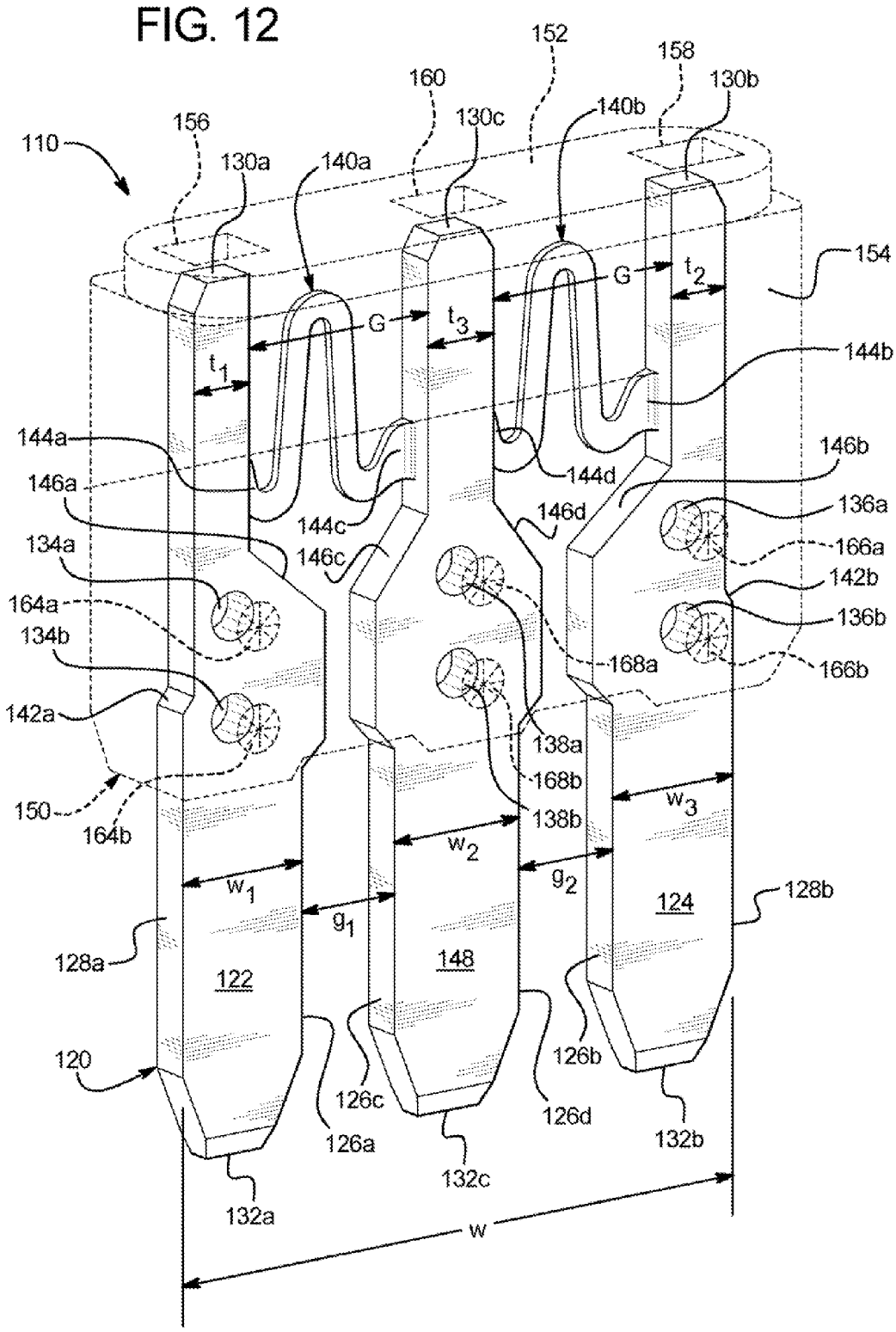
FIG. 12 is a perspective view of one embodiment of an assembled three-legged, dual fuse element fuse of the present disclosure.

First outer terminal 122 and middle terminal 148 are connected electrically via a first fuse element 140*a*. Middle terminal 148 and second outer terminal 124 are connected electrically via a second fuse element 140*b*. In FIG. 12, terminals 122, 124 and 148 include or define stake holes 134*a*, 134*b*, 136*a*, 136*b*, 138*a* and 138*b*, respectively. The stake holes receive staked portions 164*a*, 164*b*, 166*a*, 166*b*, 168*a*, 168*b* of housing 150, respectively, as discussed above for the staking operation of fuse 10.

Figure 13:
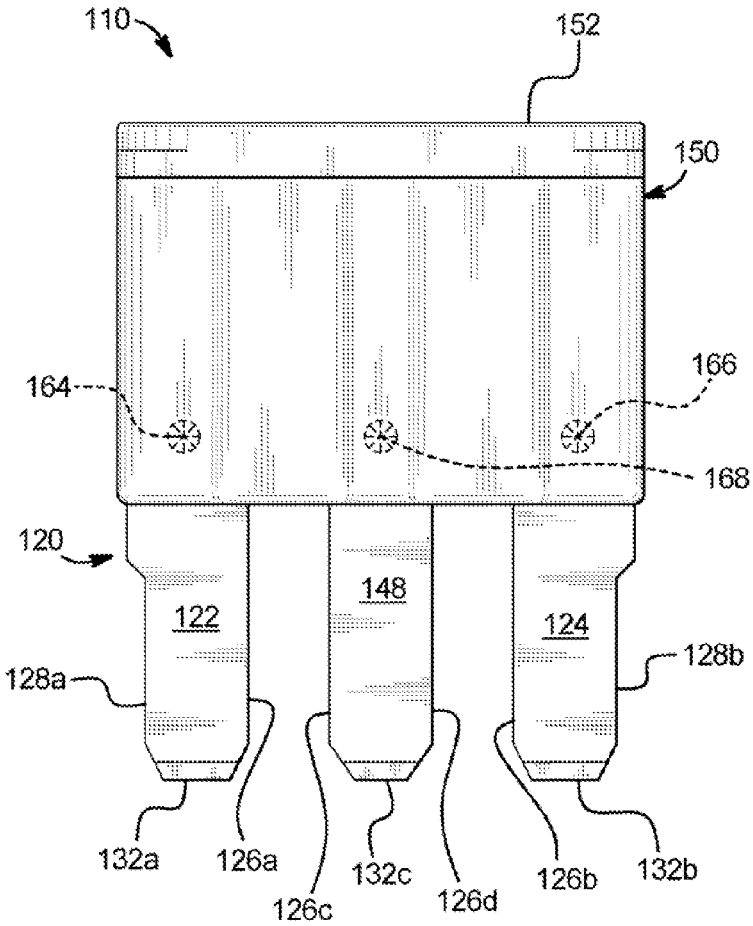
FIGS. 13 to 15 are front, side and top views, respectively, of an alternative embodiment of an assembled three-legged, dual fuse element fuse of the present disclosure.
Figure 14:
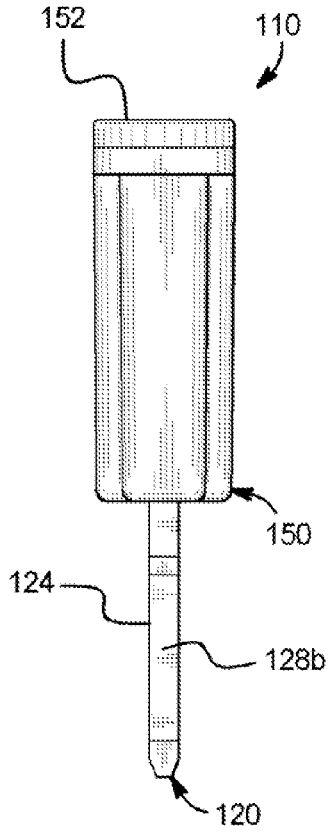
Figure 15:
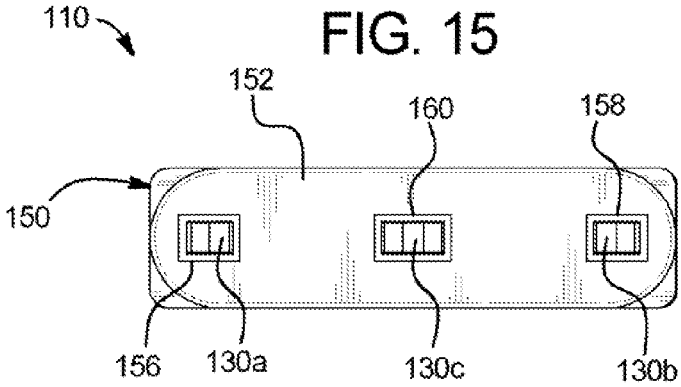
Figure 16:
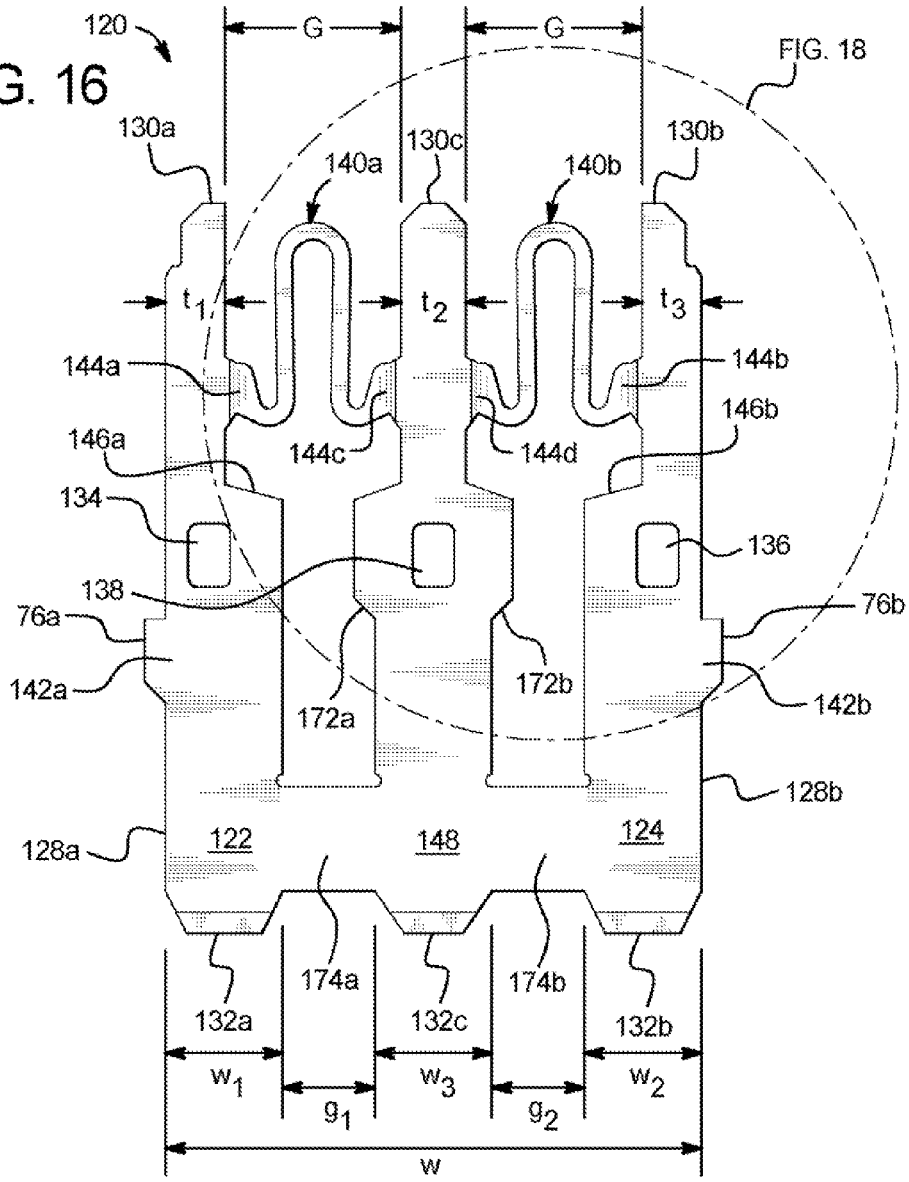
FIGS. 16 and 17 are front and top views, respectively, of one embodiment of a metal portion of the fuse of FIGS. 13 to 15.
Figure 17:
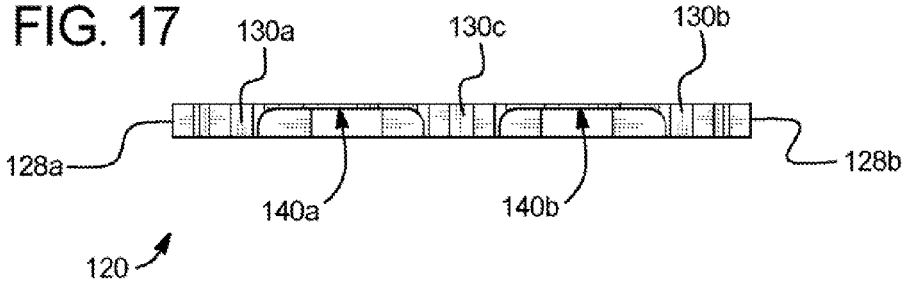
Figure 18:
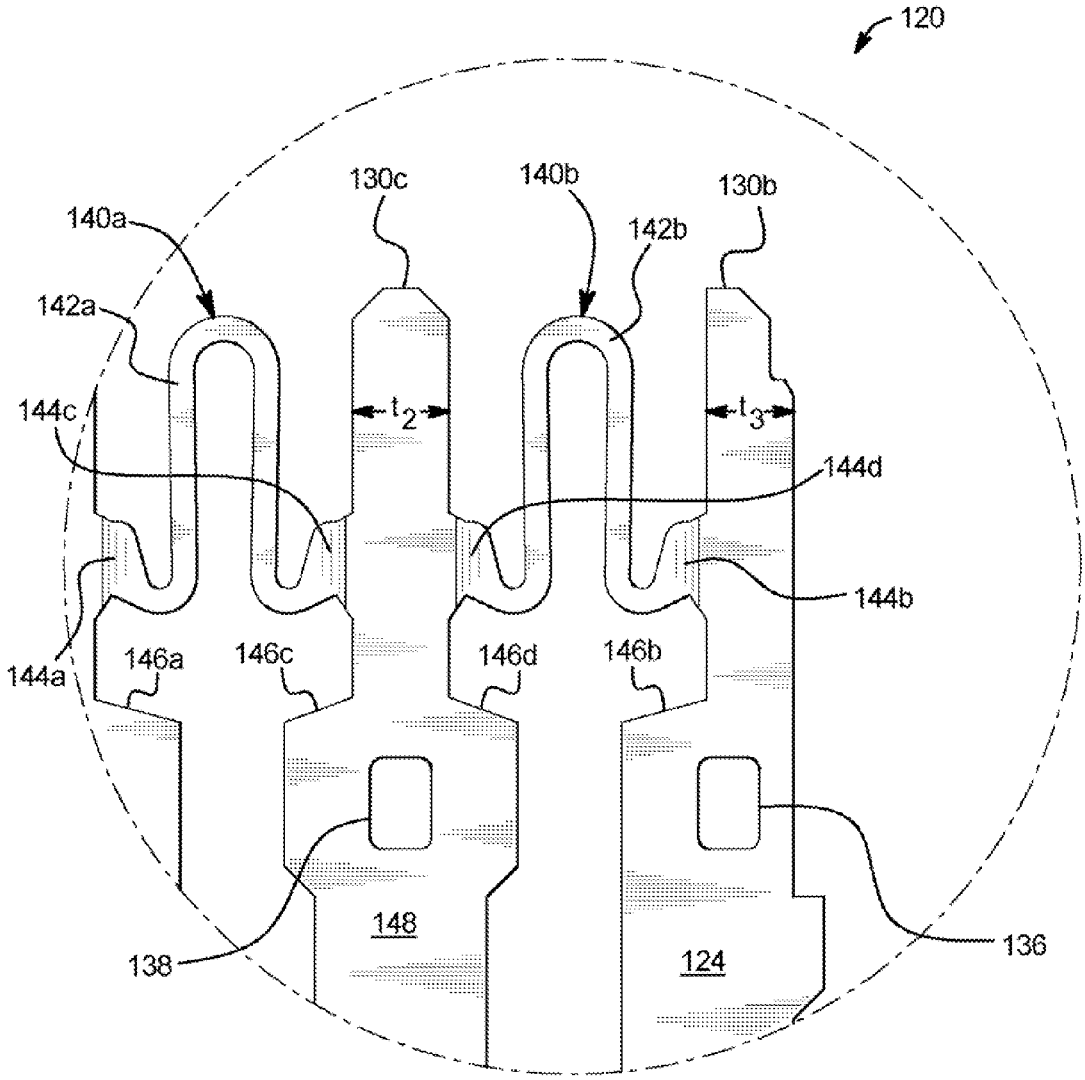
FIG. 18 is an exploded front view of the fuse element of section of the metal portion of FIGS. 16 and 17.

FIGS. 13 to 15 show a slightly alternative embodiment of housing 150. Here, a single staking portion 164, 166 and 168 of housing 150 is provided for each terminal. Each terminal as seen in FIGS. 16 and 18 includes a single stake hole 134, 136 and 138. The metal portions around the stake holes are beefed-up to allow for the stake holes. Elements 140*a* and 140*b* are located above the stake holes 134, 136 and 138.

In each embodiment, housing 150 includes a top 152 and body 154. In the illustrated embodiments, body 154 completely closes conductive portion 120 at the top of portion 120 and does not expose the outer edges 128*a* and 128*b* of terminals 122 and 124 at the top of conductive portion 120. It should be appreciated that fuse 110 alternatively does expose outer edges 128*a* and 128*b* of terminals 122 and 124. Body 154, like body 54 is open at the bottom. This is enabled because gaps g1 and g2 between terminals 122, 148 and 124, respectively, are smaller than the widths w1, w2 and w3 of each of terminals 122, 124 and 148, respectively. Thus, terminals 122, 124 and 148 cannot wedge themselves within gaps g1 and g2 during shipping.

Also, middle terminal 148 includes projections 172*a* and 172*b*, which further prevent terminals of other fuses from becoming jammed up inside body 154 of housing 150 without the need for the housing to have dual tabs that bend upward between the terminals to prevent such jamming. FIG. 16 also shows metal portion 120 in an intermediate stage of manufacture, which has tabs 174*a* and 174*b* between terminals 122, 148 and 124, respectively. Tabs 174*a* and 174*b* are provided for machining stability and are eventually removed to expose separate terminals 122, 148 and 124 as seen in FIG. 13.

As seen in the embodiment of FIGS. 13, 16 and 18, the staking of housing 150 to conductive portion 120 is done beneath elements 140*a* and 140*b*. Here, middle portions of terminals 122, 124 and 148 are provided with the staking holes. This configuration allows upper portions of the terminals having widths t1, t2 and t3 as seen in FIG. 15 to be narrower if necessary because those portions do not have to support a stake hole. Alternatively or additionally, one or more stake hole is provided near the top of terminals 122, 124 and/or 148. Staking of housing 150 to conductive portion 120 provides each of the benefits discussed above for fuse 10.

Also, the width t2 is thickened (relative to t1 and t3, such that the upper portion of center terminal 148 can serve as a common buss for the fuse. In one embodiment the centers of curved portions 142*a* and 142*b* of terminals 140 and 140*b* are not aligned with the centers between centerlines of the bottom of terminals 122, 148 ands 124. That is, if each of the centers of terminals 122 and 148 and 148 and 124 are spaced apart 5 mm, the centers of curved portions 142*a* and 142*b* are not spaced apart 2.5 mm between the centers of terminals 122 and 148 and 148 and 124. Instead the centers of curved portions 142*a* and 142*b* are moved, e.g., outwardly to account for the thickening of center thickness t2.

FIGS. 12 and 15 show that housing 150 provides three probe openings 156, 158 and 160, such that each of top edges 130*a*, 130*b* and 130*c* of terminals, respectively, can be accessed to determine the integrity of, in this case, two separate fuses. In the illustrated embodiment, middle terminal 148 is a common buss for both outer terminals 122 and 124. Thus to test integrity of element 140*a* the operator tests edges 130*a* and 130*c*. Likewise to test the integrity of element 140*b* the operator tests probes points 130*b* and 130*c*. Making middle terminal 148 the common terminal or buss terminal between the two fuses allows elements 140*a* and 140*b* to be placed between terminals 122 and 148 and terminals 148 and 124, respectively, such that overall space consumed by conductive portion 120 is minimized.

Fuse 10 indeed provides two independently operating fuses. The collective width of the overall fuse is narrowed via the same apparatus discussed above for fuse 10. In particular, the upper portions of terminals 122, 124 and 148 provided along the inner edges 126 (referring collective to edges 126*a* to 126*d*) are notched at notches 146*a*, 146*b*, 146*c* and 146*d*, respectively. Such notches allow elements 140*a* and 140*b* to be sized as needed, while allowing the overall (nominal) width W to be narrowed with respect to how wide it would have to be if such notches were not provided. Elements 140*a* and 140*b* can be rated the same or differently. Further, elements 140*a* and 140*b* can have any of the configurations shown in connection with fuse 10. Any of the alternative embodiments for attachment sections 144 (referring collectively to attachment sections 144*a* to 144*d*) and notches 146 (referring collectively to notches 146*a* to 146*d*) discussed above for corresponding connection points and notches for fuse 10 are also applicable for fuse 110.

Fuse 110 in an embodiment also provides terminals 122, 124 and 148 that have a center to center distance of 5 mm. That is, in one implementation the center to center distance between terminals 122 and terminal 148 is 5 mm, while the center to center distance of terminal 148 to terminal 124 is also 5 mm. In one embodiment, the nominal overall width W is 12.8 mm. Each terminal with w1, w2 and w3 is the same and is 2.8 mm. Terminal gaps g1 and g2 are the same and are each 2.2 mm in one implementation. Outer surfaces 128*a* and 128*b* of outer terminals 122 and 124 as seen in FIGS. 12 and 16 each show a jog 176*a* and 176*b*, respectively, which helps to position housing 150 onto metal portion 120.

In an embodiment, widths t1 and t2 are the same. Width t3 is thickened as discussed above and sized to allow element gaps G to each be about 4.2 mm for both fuses of the pair included in overall fuse 110. Alternatively, gap G for element 140*a* is different than gap G for element 140*b*.

In any of the embodiments described herein, the metal portion 20 or 120 begins with a stock metal, such as zinc. The stock is then plated, e.g., with copper or nickel and then silver or tin. The element area (40, 140) of the metal portion 20 or 120 is then skived to remove any unwanted plating, e.g., to remove a copper/silver plating, a copper/tin plating, a nickel/silver plating or a nickel/tin plating, leaving the bare base metal, e.g., zinc at element area (40, 140) and the terminals plated. Metal portion 20 or 120 is then formed as discussed herein, e.g., via repeated coining (thinning) and stamping (metal removing) steps.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A blade fuse comprising:

a first terminal including an upper portion and a lower portion, said lower portion having a width $w_1$;

a second terminal including an upper portion and a lower portion, said lower portion having a width $w_2$, said upper portion of said second terminal spaced apart from the upper portion of the first terminal to define a first gap G therebetween and the lower portion of the second terminal being spaced apart from the lower portion of the first terminal to define a second gap g, said second gap g being less than the width $w_1$ of said lower portion of said first terminal, said second gap g being less than the width $w_2$ of said lower portion of said second terminal;

a fusible element disposed within the gap G between the first and second terminals; and a projection extending from said lower portion of said first terminal toward said second terminal a distance into the gaps G and g, said projection having a polygonal shape.

2. The blade fuse of claim 1, wherein the width of the first terminal $w_1$ is narrowed at least 30 percent from the lower portion to the upper portion and the width of the second terminal $w_2$ is narrowed at least 30 percent from the lower portion to the upper portion to define the gap distance G.

3. The blade fuse of claim 1, wherein the element is at least one of: (i) curved; (ii) u-shaped; (iii) v-shaped; and (iv) serpentine.

4. The blade fuse of claim 1 wherein the fusible element is disposed completely within the second gap.

5. The blade fuse of claim 1 wherein at least one of said lower portions of said first or second terminals includes a jog that narrows said first or second lower portions to position said housing onto said first and second terminals.

6. The blade fuse of claim 5 wherein said first terminal has an outer edge that extends from said lower portion to said upper portion and said second terminal has an outer edge that extends from said lower portion to said upper portion, said outer edge of said lower portions of said first and second terminals defining a largest width W of said blade fuse wherein the second gap G being at least about 50 percent of the largest nominal width W.

7. The blade fuse of claim 1 wherein the projection is a first projection, said blade fuse comprising a second projection extending from said lower portion of said second terminal a distance toward said first terminal into the second gap.

8. The blade fuse of claim 7 wherein the second projection has a polygonal shape.

9. A blade fuse comprising:

a first terminal including an upper portion having a first width and a lower portion having a second width, said first width being less than said second width;

a second terminal including an upper portion having a first width and a lower portion having a second width, said first width being less than said second width, the lower portion of the second terminal being spaced apart from the lower portion of the first terminal to define a first gap, said first gap being less than the second width of said lower portion of said first terminal, said first gap being less than the second width of said lower portion of said second terminal;

a fusible element connecting the first and second terminals and extending from said upper portion of said first terminal to said upper portion of said second terminal wherein a second gap is defined between the upper portions of the first and second terminals;

a housing covering the element; and a projection extending from at least one of the lower portions of the first and second terminals a distance into said second gap, said projection having a polygonal shape with a first wall extending from said respective lower portion of said first or second terminal, a second wall extending from said respective lower portion of said first or second terminal and a third wall extending from said first and second walls.

10. The blade fuse of claim 9, the housing open at its bottom surface.

11. The blade fuse of claim 9, further comprising at least one aperture in each of the upper portions of the first and second terminals to retain said housing.

12. The blade fuse of claim 9, wherein the upper portions of the first and second terminals are staked to the housing.

13. The blade fuse of claim 9 wherein said fusible element is completely disposed within said second gap.

14. The blade fuse of claim 9 wherein the fusible element has a first end connected to the upper portion of said first terminal and a second end connected to said upper portion of said second terminal, said fusible element being completely disposed within said second gap.

* * * * *